United States Patent [19]

Mehta et al.

[11] 3,985,933

[45] Oct. 12, 1976

[54] FIBERS

[75] Inventors: Hemant Mehta, Delft; Willy H. J. Badrian, Voorburg, both of Netherlands

[73] Assignee: Shell Oil Company, Houston, Tex.

[22] Filed: Dec. 6, 1974

[21] Appl. No.: 530,103

[30] Foreign Application Priority Data

Dec. 6, 1973 United Kingdom ..... 56577/73
Dec. 6, 1973 United Kingdom ..... 56578/73

[52] U.S. Cl. ..... 428/357; 428/910; 264/147; 264/288; 264/DIG. 47

[51] Int. Cl.[2] ..... B32B 25/16

[58] Field of Search ..... 428/114, 357, 910, 310, 428/155, 364; 264/147, DIG. 47, 289, 288

[56] References Cited

UNITED STATES PATENTS

| | | | |
|---|---|---|---|
| 3,407,253 | 10/1968 | Yoshimura et al. | 264/289 |
| 3,551,538 | 12/1970 | Yamamoto et al. | 428/310 |
| 3,562,369 | 2/1971 | Chopra et al. | 428/364 |
| 3,634,564 | 1/1972 | Okamoto et al. | 428/910 |
| 3,697,636 | 10/1972 | Skoroszewski et al. | 428/910 |
| 3,738,904 | 6/1973 | Ikeda et al. | 428/155 |
| 3,765,999 | 10/1973 | Toyoda | 428/910 |

FOREIGN PATENTS OR APPLICATIONS

| | | |
|---|---|---|
| 1,317,557 | 5/1973 | United Kingdom |

*Primary Examiner*—William J. Van Balen

[57] ABSTRACT

Improved fibrillated fibers made by fibrillating an oriented film or sheet, where the film or sheet is from about 70 to about 99.5 weight percent of polypropylene and from about 30 to about 0.5 weight percent of a rubber selected from the group consisting of polybutadiene or polystyrene/polybutadiene block copolymer.

10 Claims, No Drawings

FIBERS

BACKGROUND OF THE INVENTION

It is known to manufacture fibers of polymeric material by spinning, i.e., by extrusion of a molten polymer through a spinneret. It is also known to manufacture such fibers by film splitting or fibrillation. In the latter method the molten polymer is extruded through a linear or annular slit to form a film or sheet. Then the film is cooled below it fusion temperature, stretched to effect molecular orientation and subsequently subjected to a mechanical treatment to induce splitting or fibrillation of the stretched film.

The use of polypropylene as starting material in the film splitting method as mentioned above is well-known. Although it offers important advantages over other fiber-forming polymers, commercial acceptance of this method for the manufacture of fibers, particularly those in the low denier range, has in some cases been hampered by some properties which to a certain extent seemed inherent to fibers made by polypropylene film splitting, such as a rather high minimum average denier, a hard hand, and a gloss which gives them a "synthetic" appearance.

Blending polyolefinic starting material with synthetic rubbers to improve properties, other than those mentioned above, of fibers made from the polyolefinic material, such as tensile strength and crimp stability, has been suggested previously for high denier filaments. One would, therefore, expect that the use, as starting material, of a film consisting of a blend of polypropylene with a synthetic rubber might improve other properties of the fibers obtained by film splitting, but it has been found that most elastomers do not or only to a very limited extent fulfill this expectation.

In contrast with these generally disappointing results it has been found that the aforementioned disadvantages of film splitting to manufacture polypropylene derived fibers are avoided or at least considerably reduced by starting from polypropylene containing a certain amount of a styrene-butadiene block copolymer or polybutadiene yielding fibers with not only a mat surface when compared with fibers made from a film of unmodified polypropylene under the same process conditions, but also a lower average denier and a remarkably softer hand resembling that of wool or silk. Moreover, fibers made from film of such blends exhibit other attractive properties, such as a narrower denier range, improved resilience, and improved dyeability without appreciable loss in tenacity.

SUMMARY OF THE INVENTION

The invention relates to improved fibrillated polypropylene fibers from film having better hand, gloss, resilience, dyeability and denier control which comprises fibers made by fibrillating an oriented film, said film being comprised of from about 70 to about 99.5 weight percent polypropylene having a weight averaged molecular weight from about 200,000 to about 1,000,000 and from about 30 to about 0.5 weight percent of a rubber selected from the group consisting of polybutadiene and polybutadiene/polystyrene block copolymers. The polybutadiene has a cis 1,4 content of at least about 90 percent and a weight averaged molecular weight of about 50,000 to about 750,000 and the said polybutadiene/polystyrene block copolymer has a polystyrene content of about 50 to about 10 weight percent, a weight average molecular weight of about 50,000 to about 200,000 and a polybutadiene block containing a cis 1,4 content of at least about 35 percent. The invention also relates to a process for forming an improved fiber from film which comprises forming a polypropylene film comprised of from about 70 to about 99.5 weight percent polypropylene and the polybutadiene or polybutadiene/polystyrene block copolymer as described above, orienting said film by stretching at an elevated temperature below its melting point and subjecting the oriented film to fibrillation conditions.

DESCRIPTION OF THE PREFERRED EMBODIMENTS

The fibers claimed in the invention are those made by the fibrillation of an oriented sheet or film said sheet or film being composed of polypropylene blended with either polybutadiene or polybutadiene/polystyrene block copolymer.

The blend of polypropylene and rubber can be made by blending pellets of the respective materials by drum tumbling, Banbury mixing, gradual introducing the rubber into a port of an extruder while extruding polypropylene or any other suitable method of evenly distributing particles of rubber throughout the polypropylene.

The polypropylene used in the present invention is any crystalizable polypropylene. Said polypropylene can be prepared by polymerizing propylene irrespective of the method used as long as a crystalizable polymer capable of being formed into a film or sheet is formed. The preferred polypropylenes are the substantially isotactic polypropylenes prepared by the Ziegler/-Natta polymerization process. Polypropylene as defined herein shall also include those polymers known commercially as "impact polypropylenes" where they contain small amounts of ethylene/propylene random polymer either as an additive or as part of the polypropylene molecules. These ethylene/propylene rubbers commonly occur in impact polypropylene in a concentration as high as 10 percent by weight.

The term weight percent (%w.) as used in the specification means the percent of the named material by weight with respect to the total composition concerned.

The molecular weight (weight averaged) of the polypropylene used in the present invention can be any value as long as the polymer can be formed into an oriented film capable of undergoing fibrillation into fibers. The preferred molecular weight is in the range of from about 200,000 to about 1,000,000, more preferred are molecular weights ranging from about 300,000 to about 600,000 and most preferred are molecular weights ranging from about 300,000 to about 450,000.

The total amount of polypropylene as defined above that is used in the fibers of this invention ranges from about 70 to about 99.5 weight percent, more preferably from about 80 to about 98 percent and most preferably from about 90 about 95.

The rubbers blended into the polypropylene to form the polypropylene/rubber blend which makes up the material used in the fibers of this invention are polybutadienes and polybutadiene/polystyrene block copolymers. These rubbers are used in the blend in an amount ranging from about 30 to about 0.5 weight percent, preferably from about 20 to about 2 weight percent and most preferably from about 10 to about 5 weight percent.

The polybutadiene used in the fibers of this invention are those having a high cis 1,4 content, preferably 90% or higher, more preferably 92 percent or higher and most preferably 95 percent or higher. The weight averaged molecular weight of the polybutadienes used in the fibers of this invention may range from about 50,000 to about 750,000 preferably from about 100,000 to about 500,000 and most preferably from about 100,000 to about 400,000.

The polybutadiene/polystyrene block copolymers used in the fibers of the present invention are those containing at least one polystyrene block and one polybutadiene block, but may contain more than one block of each type monomer. These block copolymers are well known and are described in U.S. Pat. Nos. 3,600,250, issued Sept. 9, 1968, 3,473,240, issued Oct. 21, 1969 and 3,594,452, issued July 20, 1971. The preferred block copolymers are the two block copolymers and the most preferred are the polystyrene/-polybutadiene/polystyrene three block copolymers. These block copolymers are added to the polypropylene without chemical crosslinks.

The polystyrene content of the block copolymers used in the present invention range from about 50 to about 10 weight percent, more preferably from about 35 to about 15 weight percent and most preferably from about 30 to about 15 weight percent.

The polybutadiene portion of the block copolymer are those having a cis 1,4 content of 35 percent or higher, more preferably 40 percent or higher and most preferably 45 percent or higher. The 1,2 content of the polybutadiene block is less than 20 percent, preferably less than 15 percent and most perferably less than 10 percent.

The weight average molecular weight of the block copolymer used in the fibers of the invention ranges from about 50,000 to about 200,000 preferably from about 60,000 to about 160,000 and most preferably from about 65,000 to about 160,000.

Other components may also be present in the polypropylene/rubber blend used to make the fiber such as anti-oxidants, stabilizers, plasticizers, flow improvers, pigments, and dyeability improvers. In many cases the use of lubricants has been found to be advantageous, particularly fatty amides known in the art as slip agents, e.g., those commercially available under the namer "UNISLIP" and "ACRAWAX C". The slip agents are suitably employed in amounts of 0.1 to 4%w while generally an amount of from 2.5 to 3.5%w is most preferred.

The use of fillers, such as talc, chalk, metal salts of higher fatty acids, and asbestos, is particularly suitable in some cases. The starting material may suitably comprise polymeric compounds other than polypropylene and the block copolymer. Preferred components of such type comprise, for instance, homo- or copolymers of ethylene in amounts of from 1 to 20%w. A particularly preferred additional component is high-density polyethylene in an amount of from 5 to 15%w.

The process used to make the fibers of this invention comprises the forming a sheet or film of the blend of polypropylene and polybutadiene or polybutadiene/polystyrene block copolymer, orienting said film by stretching at an elevated temperature, such as 135° or 145° C, but below its melting point to a thickness of approximately one mil or less, and subjecting the oriented film to fibrillation conditions.

In such a process the advantages of the polybutadiene or polybutadiene/polystyrene block copolymer component with respect to fiber appearance as explained herein before are of particular importance in veiw of the fundamentally non-round cross-section of the fibers obtained in such a process. Moreover, when comparing fibers obtained by such a process under the same process conditions starting from a film of polypropylene without polybutadiene or polybutadiene/polystyrene block copolymer and one of polypropylene blended with polybutadiene or polybutadiene block copolymer, the polybutadiene or polybutadiene/polystyrene block copolymer-containing fibers have not only a considerably lower average denier but also a narrower denier range, which latter property is of particular advantage in many textile operations.

The mechanical treatment of the stretched film as employed in the present process comprises all known film-splitting methods, such as grating, twisting, brushing, cutting, rubbing, exposure to a gas jet or a rapid stream of solid particles, or, under certain conditions, merely winding up under tension. A method preferably employed in the present process is in many cases to pass a stretched film under tension over a rotating cylinder provided with pins on its surface, the latter moving, at the area of contact, in the same direction as but more rapidly than the film. Particularly preferred is the use of a cylinder provided with pins positioned in rows substantially parallel to the cylinder axis. Under suitable conditions such embodiment of the present process yields a more or less regular or a completely irregular network of fibers within the required denier range as indicated hereinbefore.

The process of the invention may be carried out in many other ways. In a preferred embodiment thereof the film to be coverted into fibers is a profiled film having on at least one surface thereof parallel ridges in longitudinal direction, which film may suitably be made by extrusion of the blend through a slit having projections. Such ridges predetermine to a certain extent the degree of splitting when the film is subjected to a mechanical treatment. In another preferred embodiment the profiled film is made by subjecting a web of the blend to an embossing treatment, at a temperature which may be below the crystalline melting point of the polymeric starting material or above the melting point, the embossing treatment being followed by stretching the embossed web. If necessary, the so obtained film in stretched condition may be subjected to one of the above-mentioned mechanical treatments to obtain a fibrous product but in many cases winding up under tension is sufficient to give satisfactory splitting. In this embodiment the embossing is generally effected by passing the web under pressure contact through the nip formed between two contra-rotating rollers or belts having non-yielding surfaces, at least one of the roller or belts being profiled.

The following Embodiments are given to illustrate the invention. It is to be understood, however, that the Illustrative Embodiments are for the purpose of illustration only and the invention is not to be regarded as limited to any of the specific materials or conditions recited herein.

ILLUSTRATIVE EMBODIMENT I

A masterbatch was made by mixing 40 parts by weight (pbw) of a stereo-specific high cis-1,4-polybutadiene having an average molecular weight of 300,000 determined by gel permeation chromatography, and 60 pbw of a polypropylene having a melt index of 1.5 grams(g)/10 min. determined according to ASTM/D 1238-70, condition E.

The masterbatch was reduced to four blends containing 1, 5, 10 and 20%w of rubber, respectively, by mixing with the required additional amount of the above-mentioned polypropylene in a tumbler for 15 minutes. From each of these blends, and from the abovementioned polypropylene without rubber, a film of a width of 250 milimeters (mm) was made by extrusion at 250° C through a linear slit of 0.5 mm height.

Each of the films was stretched at 145° C at a stretching ratio of 1:8, following by relaxation without stress at 65° C, and split by passing it over a pinned roller using a contact length between roller and film of 15 centimeters (cm).

Comparing the fibers so obtained with increasing polybutadiene content they appeared to have an increasingly soft and silky hand. Other properties are given in the following Table:

| Polybutadiene content, %w | Average denier (g/9000 meters (m) | Tenacity (g/denier) |
|---|---|---|
| 0 | 14 | 2.41 |
| 1 | 12 | 2.30 |
| 5 | 10 | 2.23 |
| 10 | 7 | 2.35 |
| 20 | 7 | 2.27 |

ILLUSTRATIVE EMBODIMENT II

Four blends containing polypropylene and 5, 10, 15 and 20%w of block copolymer, respectively, were made by drytumble mixing during 10 minutes of granules of a polypropylene having a melt index of 1.5 g/10 min. determined according to ASTM D 1238-70, condition E, and granulated KRATON Thermoplastic Rubber 1101, a polystyrene/polybutadiene/polystyrene block copolymers having a polystyrene content of about 30 percent.

From each of these blends, and from the above-mentioned polypropylene without block copolymer, a film of a width of 45 mm was made by extrusion at 250° C through a linear slit of 0.5 mm height.

Each of the films was stretched at 135° C at a stretching ratio of 1:8, followed by relaxation without stress at 65° C, and split by passing it over a pinned roller using an angle of contact between roller and film of 90°, a linear film speed of 0.8 m/sec., and a peripheral roller speed of 2 m/sec. Comparing the fibers so obtained with increasing block copolymer content they appeared to have an increasingly soft and wool-like hand. The reduction of the average denier is shown by the following Table:

| Block copolymer content %w | Average denier (g/9000 m) |
|---|---|
| 0 | 15 |
| 5 | 14 |

-continued

| Block copolymer content %w | Average denier (g/9000 m) |
|---|---|
| 10 | 11 |
| 15 | 10 |
| 20 | 9 |

ILLUSTRATIVE EMBODIMENT III

1. A blend was made from 80%w of the above-mentioned polypropylene and 20%w of a random styrene/-butadiene rubber containing 23.5%w of bound styrene and having a Mooney viscosity of 52 at 100° C.

The blend was converted into film and the film subsequently stretched as described above. Splitting of the stretched film under the above-mentioned conditions resulted in fibers having an average of 10 denier but they appeared to have a very poor hand.

2. A blend was made from 99%w of the above-mentioned polypropylene and 1%w of an isoprene rubber. Extrusion of this blend to produce a film appeared to be unsuccessful, as the isoprene rubber was incompatible with polypropylene under workable extrusion conditions for polypropylene.

We claim as our invention:

1. Improved fibrillated polypropylene fibers from film, having better hand, gloss, resilience, dyeability and denier control, comprising fibers made by fibrillating an oriented film of no more than about 1 mil thickness, made by heat stretching at an elevated temperature but below its melting point a film comprised of from about 70 to about 99.5 weight percent polypropylene and from about 30 to about 0.5 weight percent of a rubber selected from the group consisting of polybutadiene and polybutadiene/polystyrene block copolymer where said polybutadiene has a cis 1,4 content of at least about 90 percent and said polybutadiene/polystyrene block copolymer has a polystyrene content of from about 50 to about 10 weight percent and the polybutadiene block has a cis 1-4 content of at least about 35 percent and 1-2 content of less than about 20 percent.

2. The improved fibers of claim 1 where the rubber content ranges from about 20 weight percent to about 2 weight percent.

3. The improved fibers of claim 1 where the rubber content ranges from about 10 weight percent to about 5 weight percent.

4. The improved fibers of claim 3 having a denier within the range of 5–10 grams/9000 meters.

5. A process for the formation of fibers which consists of:

a. forming a film comprised of about 70 to about 99.5 weight percent polypropylene and about 30 to about 0.5 weight percent of a rubber selected from the group consisting of polybutadiene and polybutadiene/polystyrene block copolymers said polybutadiene having a cis 1-4 content of at least 90 percent and said polybutadiene/polystyrene block copolymer having a polystyrene content ranging from about 50 percent to about 10 percent and a polybutadiene block having a cis 1-4 content of at least about 35 percent and a 1-2 content of less than about 20 percent, b. orienting said film by stretching it while it is at an elevated temperature but below its melting point to form an oriented film of no more than about 1 mil thickness and subjecting the oriented film to fibrillation conditions to form the fibers.

6. The process of claim 5 where the rubber content of the film is from about 20 weight percent to about 2 percent.

7. The process of claim 5 where the rubber content of the film is from about 10 weight percent to about 5 weight percent.

8. The fibers of claim 1 where the rubber is a polybutadiene/polystyrene block copolymer.

9. The fibers of claim 8 where the copolymer content ranges from about 10 weight percent to about 5 weight percent.

10. The process of claim 5 where the rubber is a polybutadiene/polystyrene block copolymer.

* * * * *